United States Patent [19]

Pfister

[11] Patent Number: 4,930,673

[45] Date of Patent: Jun. 5, 1990

[54] POWDER CHARGE OPERATED SETTING DEVICE

[75] Inventor: Norbert Pfister, Buchs, Switzerland

[73] Assignee: Hilti Aktiengesellschaft, Fürstentum, Liechtenstein

[21] Appl. No.: 317,854

[22] Filed: Mar. 2, 1989

[30] Foreign Application Priority Data

Mar. 2, 1988 [DE] Fed. Rep. of Germany ..... 3806626

[51] Int. Cl.[5] ..... B25C 1/14

[52] U.S. Cl. ..... 227/10; 227/116; 227/120; 227/136; 227/107; 227/109

[58] Field of Search ..... 227/9, 10, 11, 120, 227/135, 136, 114, 115, 116, 107, 109

[56] References Cited

U.S. PATENT DOCUMENTS

| | | | |
|---|---|---|---|
| 3,891,133 | 6/1975 | Maier et al. | 227/10 |
| 3,910,324 | 10/1975 | Nasiatka | 227/136 X |
| 4,367,837 | 1/1983 | Manino | 227/136 |
| 4,404,877 | 9/1983 | Mizuno et al. | 227/136 X |
| 4,741,467 | 5/1988 | Gassner et al. | 227/10 X |

FOREIGN PATENT DOCUMENTS 2314920 10/1974 Fed. Rep. of Germany ..... 227/10

*Primary Examiner*—Paul A. Bell

*Attorney, Agent, or Firm*—Toren, McGeady & Associates

[57] ABSTRACT

An explosive powder charge operated setting device includes a housing containing a barrel with a muzzle forming a muzzle bore at the outlet end of the barrel. Nails held in a carrier strip are fed from a magazine through a first or insertion aperture into the muzzle bore. Each nail has a head projecting outwardly from one side of the carrier strip and the nail heads have a smaller diameter than the diameter of the muzzle bore. The heads serve as stops limiting movement of the carrier strip out of the magazine. Due to the diameter difference between the nail heads and the muzzle bore, the nail heads in the stopped position do not align with the muzzle bore axis. When a nail is to be driven, it is displaced opposite to the feed direction out of the magazine into axial alignment with the muzzle bore.

4 Claims, 2 Drawing Sheets

POWDER CHARGE OPERATED SETTING DEVICE

BACKGROUND OF THE INVENTION

The present invention is directed to an explosive powder charge operated setting device with a guide magazine projecting from one side of the device. The magazine holds a nail carrier strip spring loaded for feeding the nails in the carrier strip one at a time into a muzzle bore through an insertion aperture. The nails are displaceably held in the carrier strip and the head of each nail projects outwardly from one side surface of the strip with the heads having a smaller diameter than the muzzle bore from which the nails are driven.

A powder charge operated setting device for nails is disclosed in DE-PS No. 23 14 920. The setting device has a muzzle part located on the front of the barrel. On one side of the muzzle part, there is an insertion aperture through which nails, held in a carrier strip, are fed, one at a time, into a bore of the muzzle part. The carrier strip containing the nails is fed from a guide magazine by a spring force through an insertion aperture into the muzzle bore. The magazine extends laterally outwardly from the muzzle part. When a nail is inserted into the muzzle bore, it supports itself on the muzzle bore surface. Due to the equal size of the diameter of disks on the nail and of the muzzle bore, a nail is arranged in axial alignment with the muzzle bore.

A considerable disadvantage of this setting tool is that only nails with abutment means corresponding to the diameter of the muzzle bore can be used. Carrier strips from which the nails are displaced, cannot be utilized in the known setting tool because a displacement of the carrier strip free of the nails is not possible.

SUMMARY OF THE INVENTION

The primary object of the present invention is to provide a setting device permitting the use of carrier strips from which nails can be displaced where nail abutment means do not have a diameter corresponding to the diameter of the muzzle bore.

In accordance with the present invention, the setting device is provided with an outlet aperture from the muzzle bore located diametrically opposite the insertion aperture and with a transport member arranged to engage the nail carrier strip so that the carrier strip can be displaced opposite to the feed direction of the strip out of the magazine, by a dimension equal at least to half the difference between the diameter of the nail head and of the muzzle bore.

The outlet aperture located opposite the insertion aperture permits the use of a carrier strip from which the nails can be displaced. In this arrangement, the outlet aperture permits the displacement of the carrier strip out of the muzzle bore when the strip is free of nails, whereby if a nail is missing from a holder in the carrier strip, it is assured that the carrier strip is moved through the muzzle bore until the nail with its abutment means contacts the surface of the muzzle bore or engages another stop serving the same purpose and located in the region of the muzzle bore.

Since the nail head is particularly suited as an abutment means for the nails, it is also possible because of the transport member to utilize nails where the head serves as the abutment means and where the head has a smaller diameter than the muzzle bore. When utilizing such nails, it is possible to displace the nails out of the magazine into the muzzle bore, due to the spring force acting on the carrier strip, until the heads contact the wall or surface of the muzzle bore or a stop located adjacent the muzzle bore surface. Accordingly, the transport member can return the nails opposite to the feed direction out of the magazine until they are aligned with the muzzle bore axis so that the setting operation can be carried out. The displacement travel of the transport member, which is opposite to the feed direction out of the magazine, corresponds to half the difference between the abutment means on the nail and the cooperating stop. Preferably, the nail head serves as the abutment means and the surface of the muzzle bore acts as the stop. In this arrangement, the surface of the muzzle bore can be formed as a stop which can be swiveled into and out of alignment with the muzzle bore surface.

Preferably, the transport member is connected pivotally with an actuating member located in the region of the guide magazine and arranged to produce the displacement of the nails. This arrangement provides the possibility of producing the displacement in any desired direction with respect to the transport member. Accordingly, an actuating member is preferred which can be displaced relative to the transport member. Accordingly, an actuating member is preferred which can be displaced relative to the setting device housing, essentially transversely to the feed direction of the carrier strip. It is possible to utilize the contact pressure travel usually employed in setting devices for the actuation of the actuating member, that is, the displacement of the muzzle relative to the housing for effecting the displacement of the transport member by means of a cam control.

Since it is possible for the transport member to engage the carrier strip for effecting the displacement travel, an engagement nose or lug for the carrier strip is provided preferably at the end of the transport member, facing away from the connection with the actuating member. Such an engagement lug cooperates with entrainment means on the carrier strip and such entrainment means can be formed as projections, recesses or the like. The arrangement of the engagement lug at the end of the transport member, facing away from the connection point to the actuating member, permits the transport member to be formed as a lever pivotally mounted at the connection point. As a result, the engagement and release of the carrier strip by the engagement lug can be easily designed.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figures 1, 2:
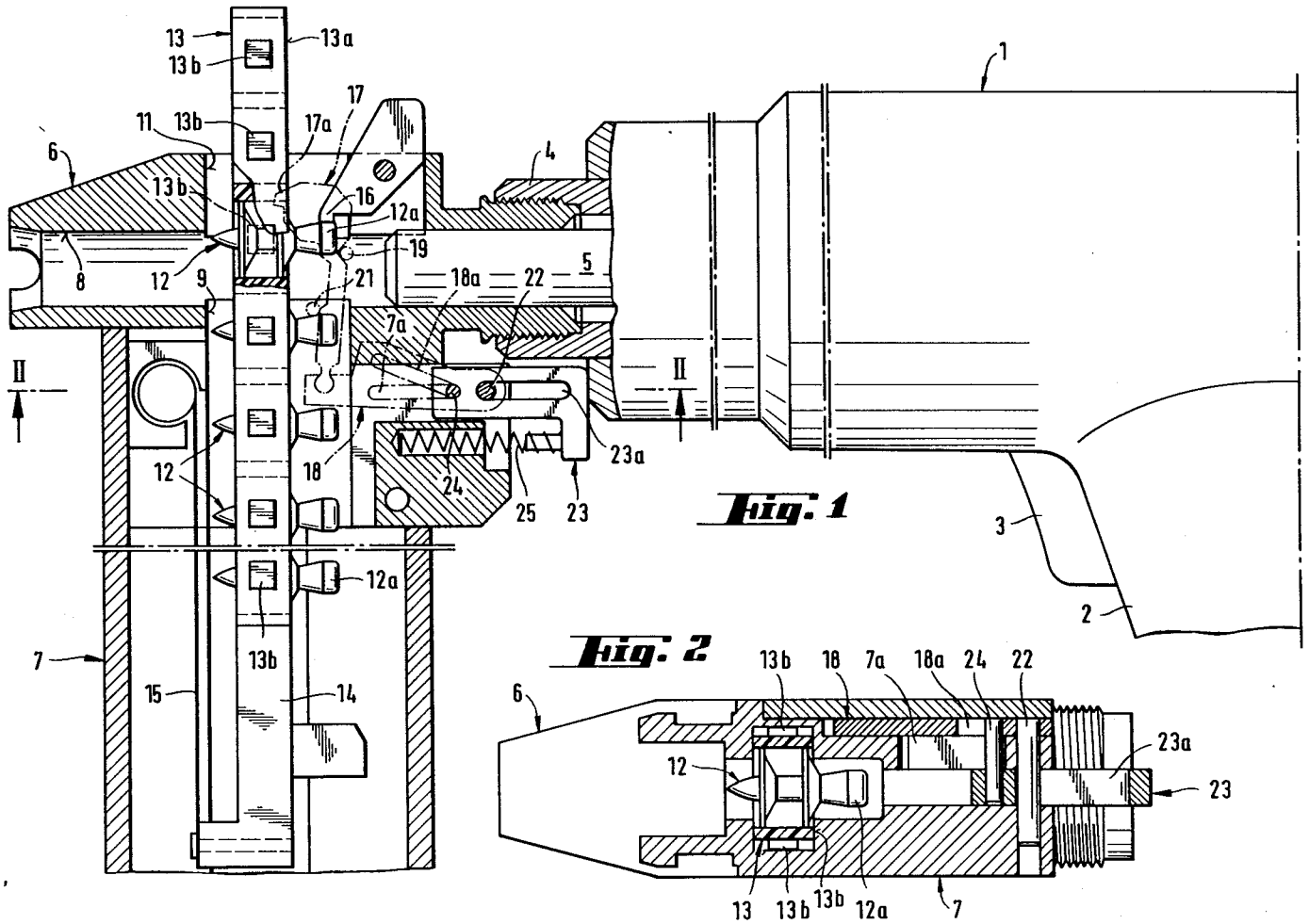
FIG. 1 is a side elevational view, partly in section, of a setting device with a nail carrier strip located within a magazine for introducing nails into the device.
FIG. 2 is an enlarged simplified sectional view taken along the line II—II in FIG. 1.
Figure 3:
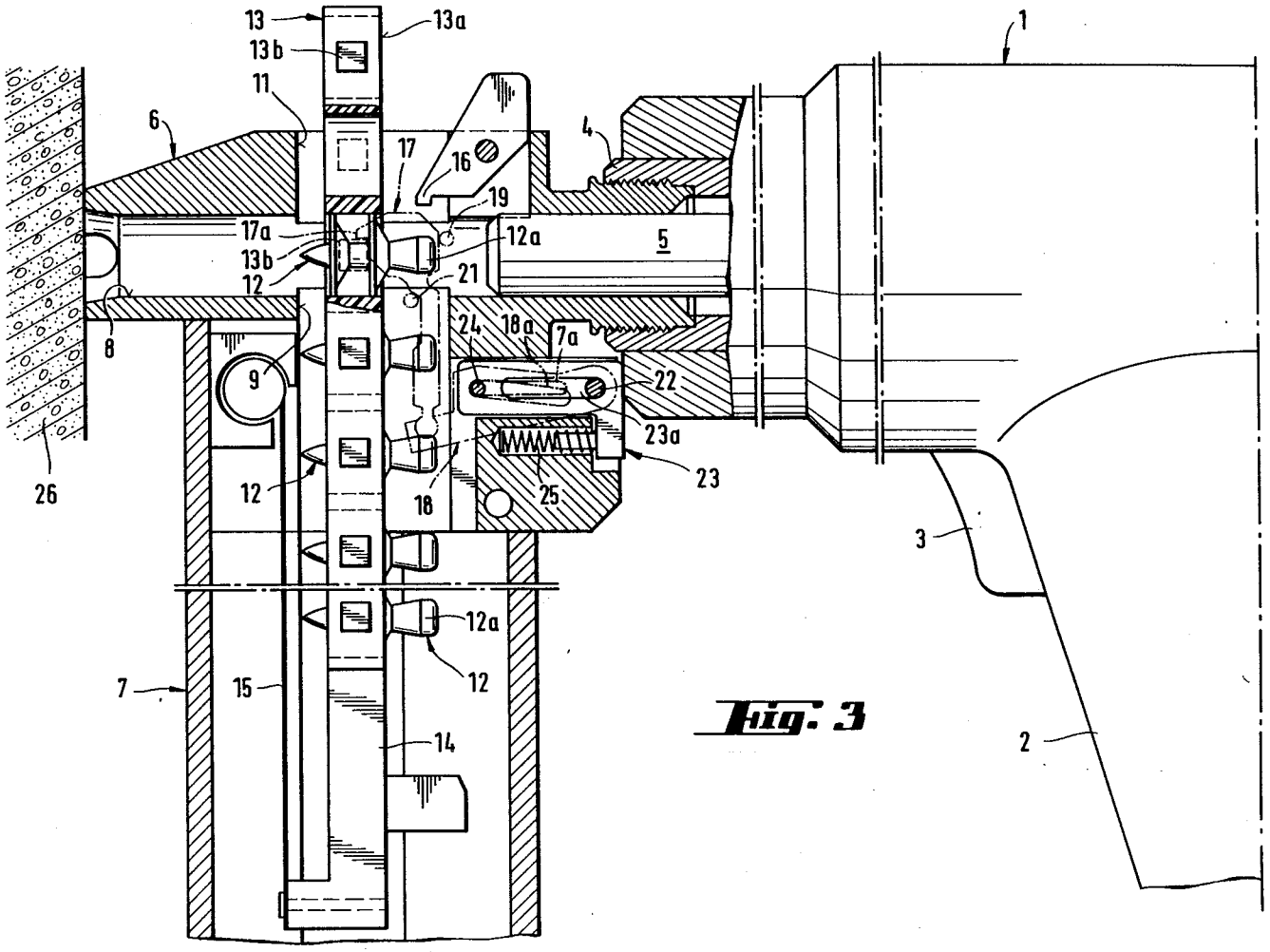
FIG. 3 is a view of the setting device, similar to that shown in FIG. 1, and ready to drive a nail from the device.

In FIGS. 1 and 3, a setting device is illustrated for driving nails. The setting device includes a housing 1 with a handle 2 located at its upper or rear end, with the handle extending transversely outwardly from the housing. A trigger 3 is mounted in the handle 2 for operating the setting device. In the housing 1, a barrel 4 is displaceably supported, as is conventional in such setting devices. For driving a nail, a driving piston 5 is mounted in the barrel and in FIGS. 1 and 3, the piston is shown in a retracted position.

A muzzle part 6 is in threaded engagement with the front end or lower end of the barrel 4. A guide magazine 7 projects laterally outwardly from the muzzle part 6. Muzzle part 6 has an axially extending bore 8 forming an axial continuation of the barrel 4. When an explosive powder charge is ignited within the setting device, the drive piston is driven into the muzzle bore. An insertion or first aperture 9 is located on the right hand side of the muzzle part 6, and opens into the muzzle bore 8. Diametrically opposite the first aperture 9, is an outlet or second aperture 11, located in the muzzle part 6 and communicating with the muzzle bore 8. A carrier strip 13 containing a number of nails 12, spaced apart, is positioned in the guide magazine 7, so that individual nails can be fed stepwise, or one at a time through the first aperture 9 into the muzzle bore 8. The heads **12*a* of the nails 12 project outwardly from the upper surface 13*a* of the carrier strip 13. A slide 14 is located in the guide magazine 7, in contact with the right-hand end of the carrier strip. A scroll spring 15 is secured within the magazine 7, and is attached to the rearward end of the slide for biasing the strip and the individual nails in the feed direction for locating the nails in the muzzle bore. Accordingly, the leading nail 12 in the feed direction is displaced into the muzzle bore 8 and its head 12*a* runs up against a stop 16 which is pivoted inwardly toward the second aperture 11. The nail 12, which has moved into contact with the stop 16, since it has a diameter smaller than the diameter of the muzzle bore 8**, is located offset in the feed direction relative to the muzzle bore axis.

To locate the nail in the proper driving position, after it has run up against the stop 16, the nail must be displaced opposite to the feed direction into alignment with the muzzle bore axis. For effecting the return movement of the nail into alignment with the muzzle bore axis, a transport member 17 is provided. Transport member 17 has an engagement lug **17*a* which co-acts with projections 13*b*, extending laterally outwardly from the carrier strip 13. Transport member 17 is constructed as a rocking lever, and spaced from the engagement lug 17*a*, is rotatably supported on an actuating member in the form of a pivotal arm 18**.

In the position shown in FIG. 1, the transport member is retained by control pins 19, 21, spaced apart in the feed direction of the carrier strip displaced out of engagement with respect to the projections **13*b*. Arm 18 is pivotally supported adjacent the guide magazine 7, by a support bolt 22 at a location spaced upwardly form the joint connection with the transport member 17 as shown in FIG. 2. Support bolt 22 extends through a tappet 23 located in the region of a vertically extending slot 23*a*. Tappet 23 is displaceable relative to the guide magazine 7, transversely of the feed direction of the carrier strip 13. A pin 24 is located in the tappet 23 and projects through a slot 7*a* in the guide magazine 7, extending parallel to the displacement axis of the tappet 23, note FIG. 2, and engages into a slot 18*a* of the arm 18, with the slot 18*a* inclined relative to the displacement axis of the tappet. The tappet 23 projects beyond the guide magazine opposite the nail driving direction and is retained in contact with the setting device housing 1 by a pressure spring 25. The setting device is moved into the position ready for driving a nail, as shown in FIG. 3, by pressing the muzzle part 6 against the receiving material 26 into which the nails are to be driven. As a result, the housing 1 is displaced relative to the guide magazine 7 and the muzzle part 6 moving relative to the housing 1. The front end face of the housing 1 presses the tappet 23 in the setting direction against the force of the pressure spring 25. Pin 24, supported in the tappet 23, slides along the slot 7*a* in the guide magazine 7 and along the inclined slot 18*a* in the arm 18. As a result, arm 18 is pivoted counter-clockwise, note FIG. 3, by the pin 24 around the bearing bolt 23 and carries the transport member 17 in the direction counter to the feed direction of the carrier strip 13. In the initial phase of the entrainment of the transport member 17, the transport member is shifted by the control pin 19 into the path of the projections 13*b* on the carrier strip 13 for displacing the carrier strip 13 along with the nails 12 opposite to the feed direction for aligning the leading nail in the strip into alignment with the axis of the muzzle bore due to the engagement of the transport member with the projections 13*b*, as is shown in FIG. 3. The displacement travel of the carrier strip counter to the feed direction corresponds at least to half of the difference between the diameters of the head 12*a* and the muzzle bore 8**.

In this engagement position, the transport member 17 is held by the control pin 19 until the muzzle part 6 is lifted off the surface of the receiving material 26. During the lift-off movement of the muzzle part 6, the housing returns into the position shown in FIG. 1. Further, the tappet 23 is returned by the pressure spring 25 back into its initial position displayed in FIG. 1. Similarly, transport member 17 arrives back into the position shown in FIG. 1 as the arm 18 pivots in a return movement due to the above movement of the tappet. In such movement, control pin 21 lifts the transport member 17 out of the path of the projections **13*b* and the control pin 19 enters into a recess in the transport member 17. Therefore, slide 14 can feed the carrier strip 13 into the muzzle bore until the next head 12*a* of a nail 12, located in the strip moves into contact with the stop 16. Carrier strip 13 free of any nails 12, moves out of the muzzle part 6 through the second aperture 11**.

The driving of the nail 12 aligned with the axis of the muzzle bore 8 is effected by the displacement of the drive piston 5 into the muzzle bore 8, whereby the nail is pressed out of the carrier strip when the piston contacts the nail head **12*a* and drives it into the receiving material 26. Before the carrier strip is moved into or through the muzzle bore, in an additional step the drive piston is returned by known means into the position shown in FIG. 1**.

While specific embodiments of the invention have been shown and described in detail to illustrate the application of the inventive principles, it will be understood that the invention may be embodied otherwise without departing from such principles.

I claim:

1. Explosive powder charge operated setting device comprises a housing, a barrel located within said housing and having an axially extending barrel bore, a muzzle part forming an extension of said barrel and located at one end of said housing, said muzzle part having a muzzle bore forming an axial extension of said barrel bore, a guide magazine located at and extending transversely of said muzzle part and arranged to hold a nail carrier strip containing a plurality of axially extending spaced nails with a head on one end of each said nails, spring means for biasing the nail carrier strip out of said magazine through a first aperture in said muzzle part into said muzzle bore, said carrier strip having a first side and said nail heads projecting axially outwardly from said first side, said nail heads having a diameter less than the diameter of said muzzle bore, wherein the improvement comprises that said muzzle part has a second aperture located diametrically opposite and aligned with said first aperture and forming an outlet opening for said carrier strip from said muzzle bore, and transport means mounted on said muzzle part for displacing said carrier strip opposite to the direction in which said strip is biased by said spring means in said magazine through a distance at least half the difference between the diameter of said nail head and of said muzzle bore.

2. Explosive powder charge operated setting device, as set forth in claim 1, wherein said transport means is pivotally connected with an actuating member arranged at the guide magazine and producing the displacement travel of said transport member.

3. Explosive powder charge operated setting device, as set forth in claim 2, wherein said actuating member is displaceable relative to said housing transversely of the feed direction of the carrier strip through said magazine into said muzzle bore.

4. Explosive powder charge operated setting device, as set forth in claim 3, wherein the transport means includes an engagement lug for engagement with said carrier strip and said engagement lug located in spaced relation from a connection point of said transport member with said actuating member.

* * * * *